US006305577B1

(12) United States Patent
Fillmore et al.

(10) Patent No.: US 6,305,577 B1
(45) Date of Patent: Oct. 23, 2001

(54) SQUEEZE DISPENSER PACKAGE FOR VISCOUS PRODUCTS

(75) Inventors: William E. Fillmore, Toledo; Raj Krishna, Sylvania; Jeffrey L. Schwartz, Maumee, all of OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

(21) Appl. No.: 07/759,328

(22) Filed: Sep. 13, 1991

(51) Int. Cl.[7] ..... B67D 37/00

(52) U.S. Cl. ..... 222/95; 222/105; 222/107; 222/212; 222/494

(58) Field of Search ..... 222/95, 94, 105, 222/107, 209, 212, 213, 386.5, 490, 183, 494

(56) References Cited

U.S. PATENT DOCUMENTS

| | | | | |
|---|---|---|---|---|
| 2,608,320 | * | 8/1952 | Harrison | 222/386.5 X |
| 2,743,038 | | 4/1956 | Ferries | 222/95 |
| 2,804,995 | | 9/1957 | Fee | 222/95 |
| 3,241,722 | * | 3/1966 | Nissen | 222/386.5 X |
| 3,592,360 | * | 7/1971 | Aleck | 222/95 |
| 3,592,365 | | 7/1971 | Schwartzman | 222/386.5 X |
| 3,620,420 | * | 11/1971 | Normos | 222/386.5 |
| 3,656,660 | * | 4/1972 | Mueller | 222/94 |
| 3,669,323 | | 6/1972 | Harker . | |
| 3,880,326 | * | 4/1975 | Kennard et al. | 222/95 |
| 4,089,443 | * | 5/1978 | Zringi | 222/386.5 |
| 4,098,434 | | 7/1978 | Uhlig . | |
| 4,469,250 | | 9/1984 | Evezich | 222/95 X |
| 4,562,942 | * | 1/1986 | Diamond | 222/386.5 |
| 4,760,937 | | 8/1988 | Evezich | 222/95 |
| 4,842,165 | | 6/1989 | Van Coney | 222/95 |
| 4,909,416 | | 3/1990 | Evezich | 222/95 |
| 5,004,123 | * | 4/1991 | Stoody | 222/94 |
| 5,033,647 | * | 7/1991 | Smith et al. | 222/94 |

FOREIGN PATENT DOCUMENTS

| | | | | |
|---|---|---|---|---|
| 2081244 | * | 12/1971 | (FR) | 222/386.5 |
| 2184491 | * | 6/1987 | (GB) | 222/386.5 |

* cited by examiner

*Primary Examiner*—Kenneth Bomberg

(57) ABSTRACT

A squeeze dispenser package comprising a container having a compressible portion and a hanger and pouch assembly of plastic material, suspended in the container. The hanger has an upper portion having an opening and a flexible film pouch having an opening is bonded to the opening in the hanger and has portions thereof bonded to the hanger. The hanger has a lower flexible portion comprising spaced flexible walls. In one form, a removable head is mounted on the container and overlies the hanger and pouch assembly. The head includes a nozzle having an opening overlying the opening in the pouch and an atmospheric valve is provided for equalizing the pressure after the compressible portion of the container has been released and the hanger and pouch assembly returns to its original position.

43 Claims, 11 Drawing Sheets

SQUEEZE DISPENSER PACKAGE FOR VISCOUS PRODUCTS

BACKGROUND AND SUMMARY OF THE INVENTION

It has heretofore been suggested that dispensers for viscous products comprise a container which contains the product and which is squeezed to dispense the product. In one type of such dispenser, a bag or pouch containing the viscous product is provided within a container so that when the compressible sidewall of the container is squeezed, the product is dispensed through a opening or nozzle. In U.S. Pat. No. 2,608,320 issued Aug. 26, 1952 there is shown a dispenser which has a cartridge as a refill unit which contains the viscous product. The cartridge has a rigid upper portion and a flexible lower portion and is suspended in a container or holder and a removable cap is provided on the container. When the flexible portion of the container is squeezed, the viscous product is dispensed through an opening in a disk on the upper end of the cartridge and an opening in the cap. An atmospheric valve is provided on the lower end of the container which closes upon squeezing of the flexible portion of the container. Other similar dispensers are shown in U.S. Pat. Nos. 2,743,038 (1956) and 2,804,995 (1957) which have an opening that is covered by the finger of the user rather than an atmospheric valve. Dispensing closures with a valve in the dispensing portion have also been suggested in the prior art as shown in U.S. Pat. Nos. 3,592,365 (1971), and 3,669,223 (1972). Squeeze pump packages are shown in U.S. Pat. Nos. 4,842,165,4,098,434, 4,469,250, 4,760,937 and 4,909,416.

Among the objectives of the present invention are to provides a squeeze dispenser package which comprises a novel hanger and pouch assembly; wherein the package can be filled from the top; wherein the pouch is fully preformed before filling; wherein the package can be refilled by replacing the hanger and pouch assembly; wherein the package can be readily manufactured in high production; and which efficiently dispenses the viscous product.

In accordance with the invention, a squeeze dispenser package comprising a container having a compressible portion and a hanger and pouch assembly of plastic material, suspended in the container. The hanger has an upper portion having an opening and a flexible film pouch having an opening is bonded to the opening in the hanger and has portions thereof bonded to the hanger. The hanger has a lower flexible portion comprising spaced flexible walls. In one form, a removable head is mounted on the container and overlies the hanger and pouch assembly. The head includes a nozzle having an opening overlying the opening in the pouch and an atmospheric valve is provided for equalizing the pressure after the compressible portion of the container has been released and the hanger and pouch assembly returns to its original position.

DESCRIPTION

Figure 1:
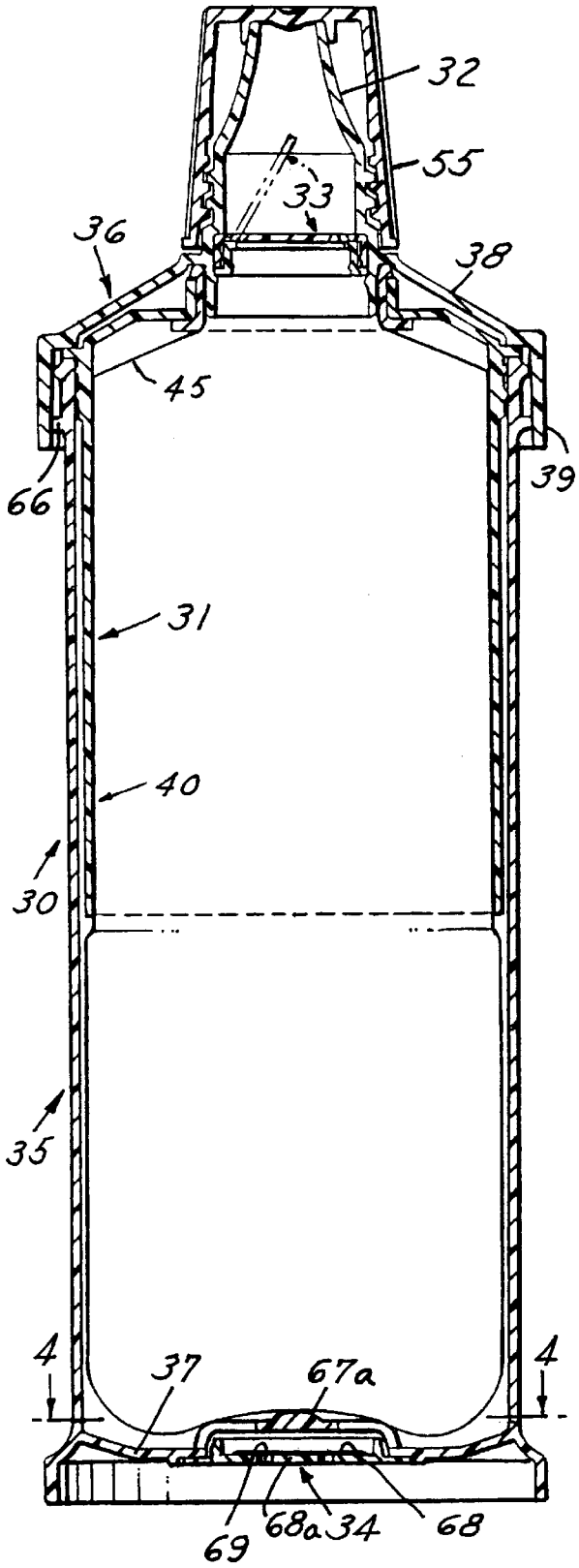
FIG. 1 is a sectional elevational view of a squeeze dispenser embodying the invention.
Figure 2:
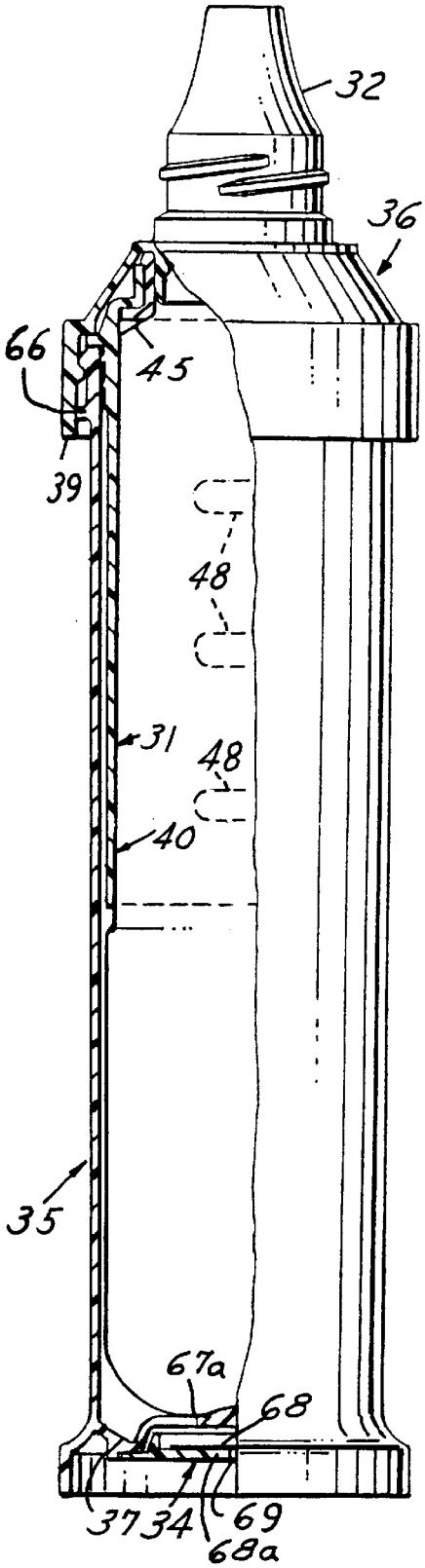
FIG. 2 is a part sectional side elevational view of the dispenser package shown in FIG. 1.
Figure 3:
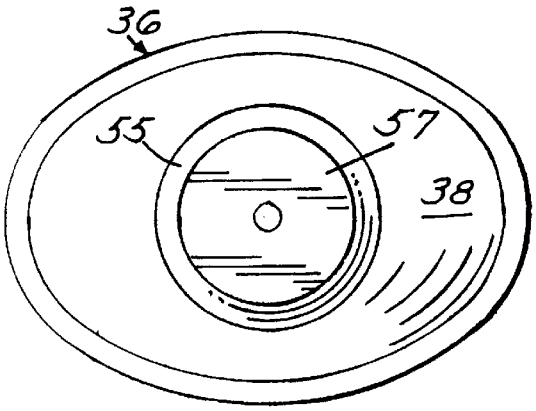
FIG. 3 is a top plan view.
Figure 4:
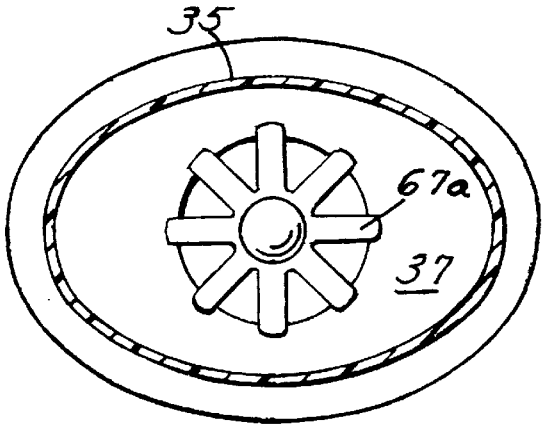
FIG. 4 is a sectional view taken along the line 4—4 in FIG. 1 with the pouch removed.
Figure 5:
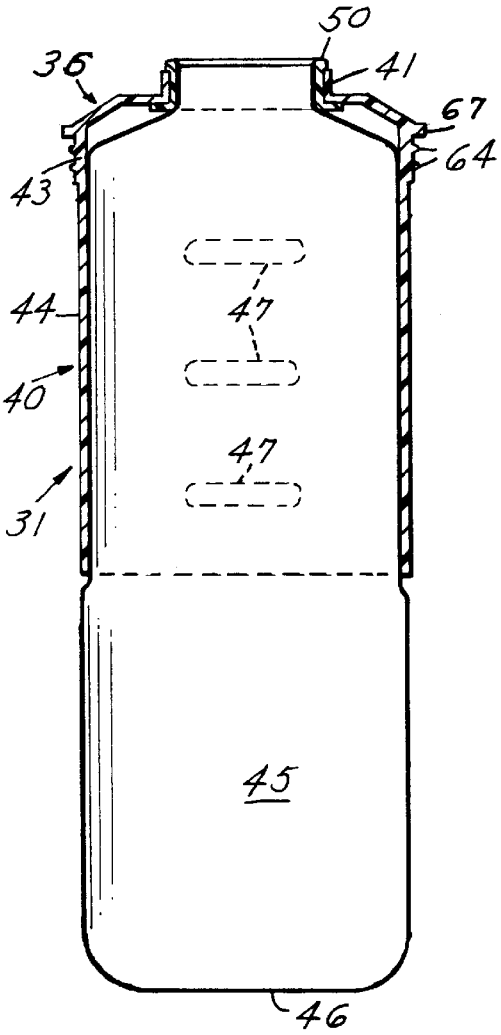
FIG. 5 is a vertical sectional view of a hanger and pouch assembly used in the package.

Referring to FIGS. 1–10 a squeeze dispensing package embodying the invention comprises a container 30, a hanger and pouch assembly 31, a dispensing nozzle 32, a check valve 33 adjacent the hanger and pouch assembly 31 and an atmospheric valve 34.

In this form, the container 30 includes a body portion 35 and a removable head 36. The body portion 30 is generally oval in cross section and has a closed bottom wall 37 and an open upper end. The head 36 includes the nozzle 32 as an integral part thereof and a generally oval shoulder portion 38 includes a peripheral skirt 39, which interengages the upper end of the body portion 35 as presently described.

The hanger and pouch assembly 31 comprises a hanger 40, a pouch 45 and a ferrule 50. The hanger 40 includes a relatively rigid upper portion including a cylindrical portion 41, oval shoulder portion 42 and oval skirt portion 43. The hanger 40 further includes a relatively flexible substantially imperforate lower portion 44 which is generally oval in cross section.

The pouch 45 of the hanger and pouch assembly 31 comprises flexible film which is suspended and extends substantially beyond the lower portion 44 of the hanger.

The bottom 46 of the pouch is closed and the upper portion of the pouch is bonded to the inner surface of the flexible lower portion 44 of the hanger 40 at circumferentially spaced and vertically spaced areas so that the upper portion of the pouch 45 will be moved by the flexing of the lower portion 44 of the hanger. Preferably, the pouch 45 is bonded to the flexible portion 44 by heat sealing at vertically spaced areas 47, 48 along the long and short sides.

The pouch 45 may be sealed to the cylindrical opening 41 of hanger 40 directly or indirectly. As shown in FIGS. 1, 2 and 5–7, the open upper end of the pouch 45 is sealed by heat bonding to the ferrule 50 which is then snapped into the opening defined by the cylindrical portion 41.

Figure 10:
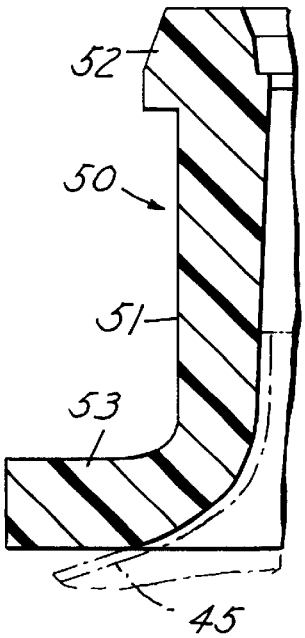
FIG. 10 is a fragmentary sectional view on an enlarged scale taken along the line 10—10 in FIG. 9.
Figure 8:
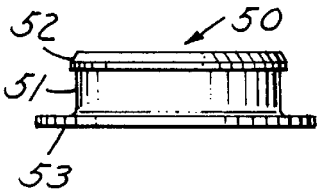
FIG. 8 is an elevational view of a part utilized in some of the packages.
Figure 9:
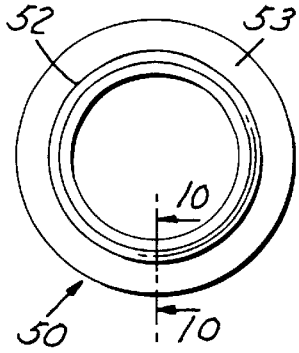
FIG. 9 is a plan view of the part shown in FIG. 8.
Figure 11:
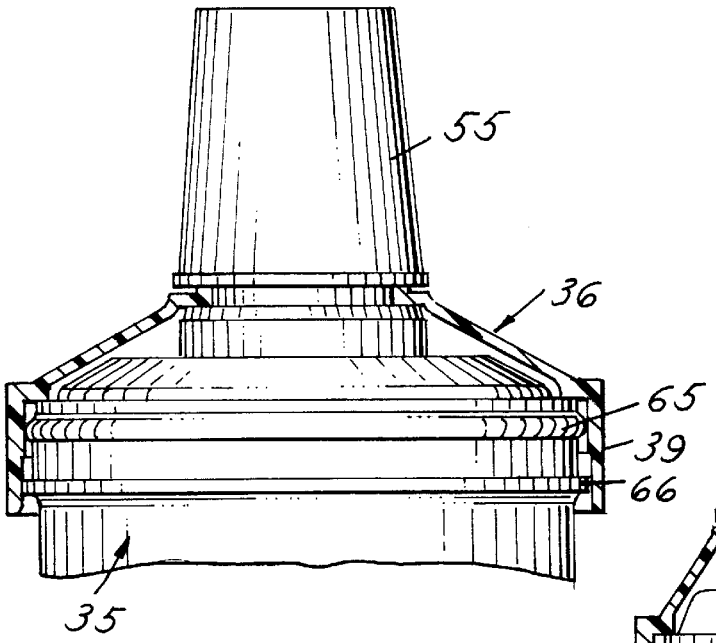
FIG. 11 is a fragmentary part sectional elevational view of a portion of the package shown in FIGS. 1–7.
Figure 12:
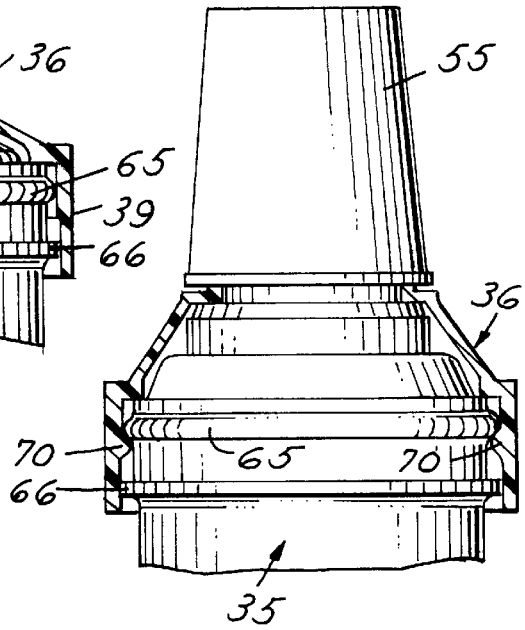
FIG. 12 is a fragmentary part sectional side elevational view of the portion of the package shown in FIG. 11.
Figure 13:
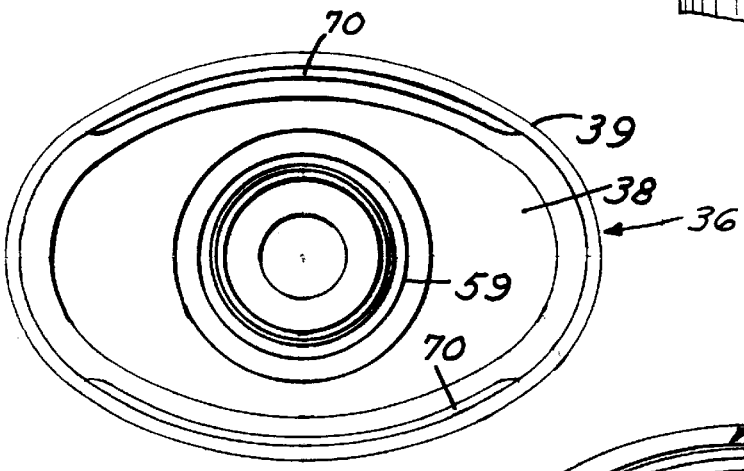
FIG. 13 is a bottom plan view of the head of the package shown in FIGS. 11 and 12.
Figure 14:
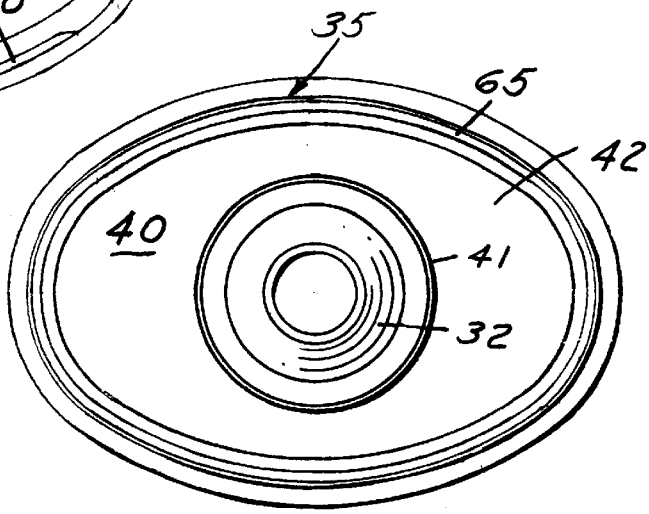
FIG. 14 is a plan view of the upper end of the container of the package shown in FIGS. 11 and 12.
Figure 15:
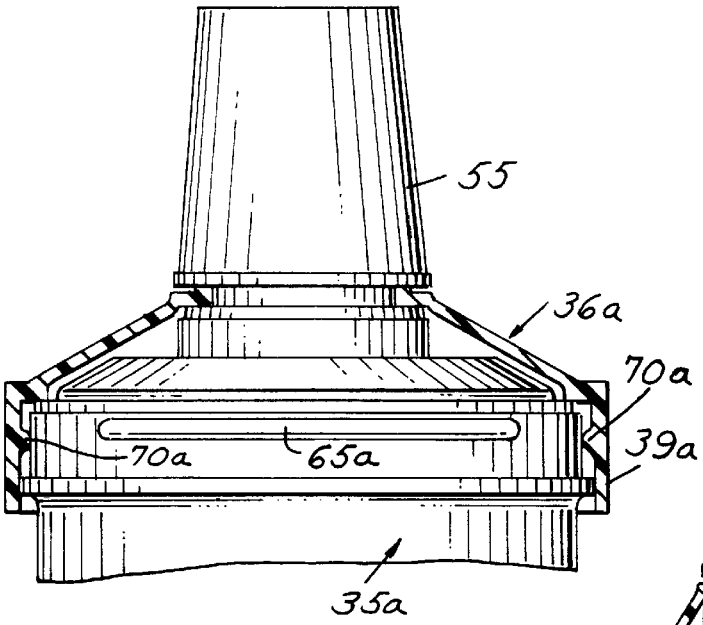
FIGS. 15–18 are views similar to FIGS. 11–14 of a modified form of package.
Figure 16:
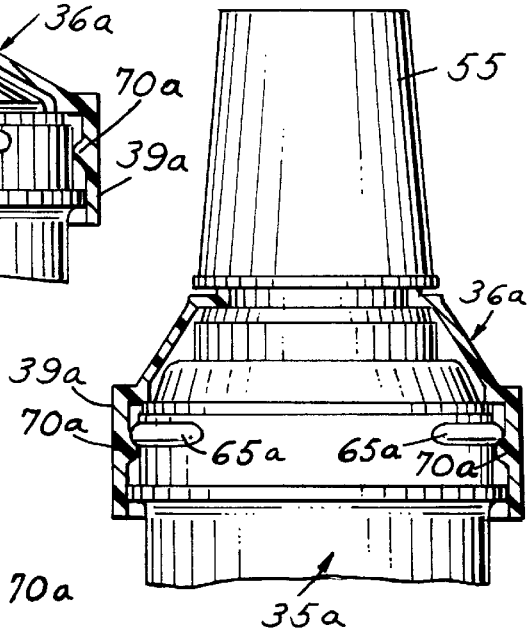
Figure 17:
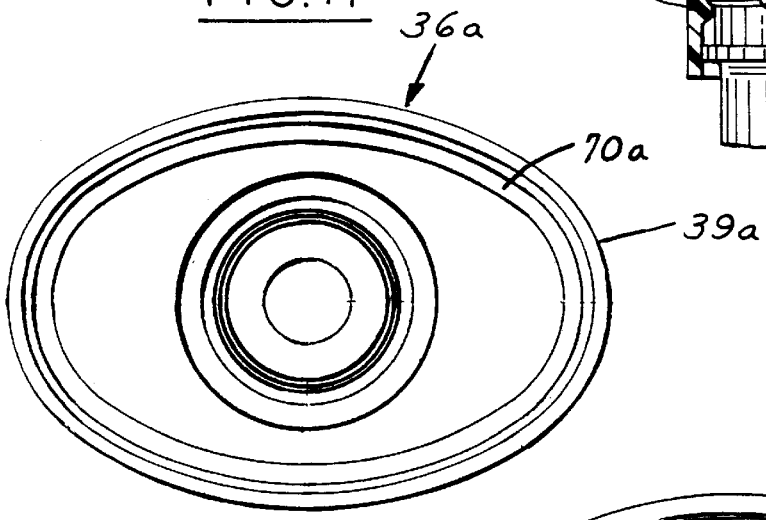
Figure 18:
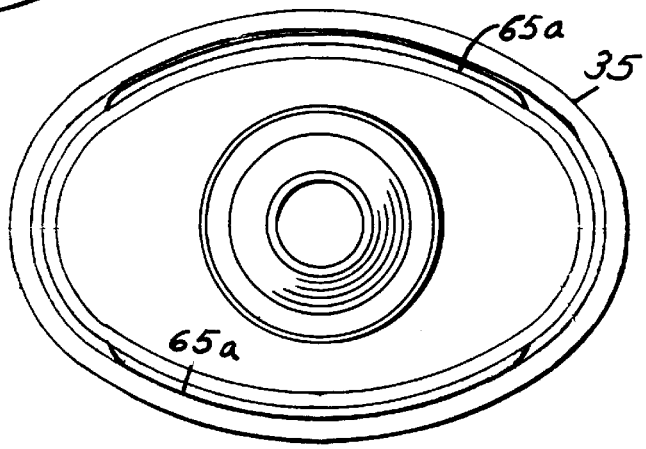

Referring to FIGS. 8–10, the ferrule 50 includes a central cylindrical body portion 51, an upper flange 52 and a wider lower flange 53. The upper end of the pouch 45 is sealed to the lower part of the cylindrical body portion 53, as shown in broken lines in FIG. 10.

Figure 6:
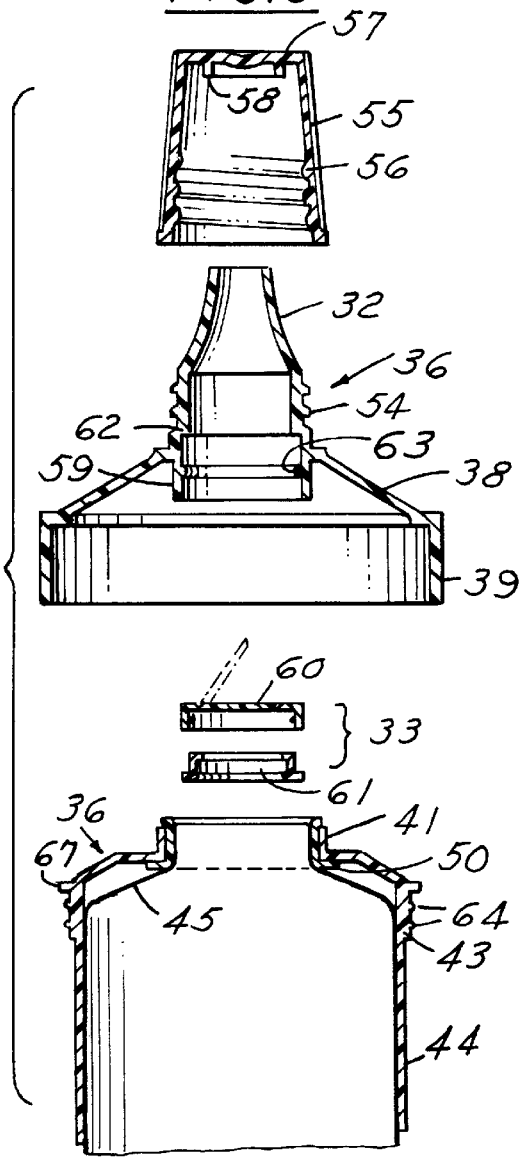
FIG. 6 is a fragmentary sectional exploded view of portions of the package.
Figure 7:
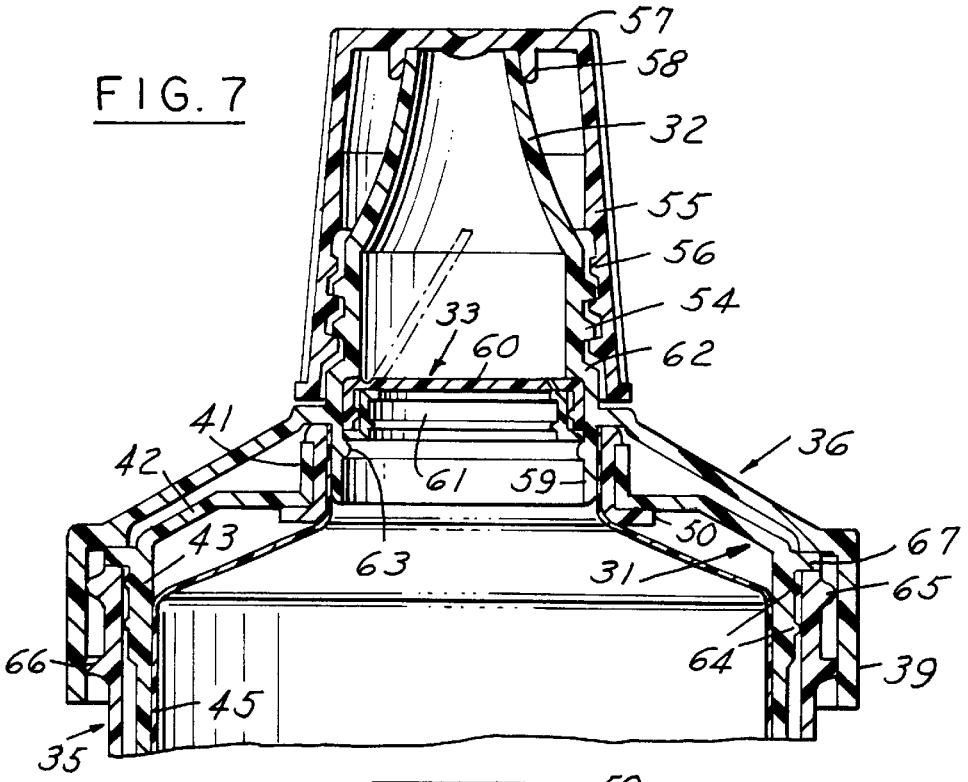
FIG. 7 is a fragmentary sectional view on an enlarged scale of a portion of the package shown in FIG. 1.

Referring to FIGS. 6 and 7, the head 36 includes an integral nozzle 32 which has an external thread 54 for threading of a closure 55 having an internal thread 56 thereon so that the base wall 57 of the closure 55 engages and encloses the open end of the nozzle 32. The base wall 57 of closure 55 preferably includes an annular wall 58 that has a tapered inner surface sealingly engaging the periphery of nozzle 32.

The head 36 further includes an axial portion 59 that extends into the open end of the ferrule 50 and sealingly engages the open end of the pouch 55 by cylindrical to cylindrical surface contact.

The check valve 33 preferably comprises a flap type valve 60 and a valve seat 61 against which the flap valve seats. The assembled valve 33 is snapped into position between a shoulder 62 on the head 36, an annular bead 63 on the axial portion 59.

The outer surface of the relatively rigid portion 43 of the hanger 40 is formed with axially spaced annular ribs 64 that provide an interference fit with the inner surface of the upper end of the body portion 35 of the container. The skirt 39 of the head 36 engages a continuous bead 65 that maintains the interference fit. The body portion 35 includes a flange 66 spaced axially below bead 65 to prevent the entry of diverse particles and the like.

The hanger 40 includes an annular flange 67 that engages the upper end of the body portion 35.

The body 35 of the container is molded with a gate spider 67*a* in the bottom wall defining a plurality of circumferentially spaced openings for the passage of air. The atmospheric valve 34 comprises a film flap valve 68 which is bonded, preferably by heat sealing, to a disk 68*a* which, in turn, is bonded to the lower wall of the container. The disk 68*a* has openings 69 underlying the film flap valve 68 such that in operation of the squeeze dispenser package, the film flap valve 68 may open and equalize the pressure surrounding the pouch 55. Alternatively, the atmospheric or equalizing valve could be mounted elsewhere on the package.

Referring to FIGS. 11–14, provision is made for retaining the head 36 on the body portion while permitting the head 36 to be removed by a relative twisting between the head 36 and body portion 35. The inner surface of the skirt 39 is formed with bead segments 70 along the long sides of the skirt. The head 36 is applied to the body portion 35 by snapping the head in place. The rigid skirt 39 of the head 36 provides intimate contact with the retaining bead 65 on the body portion providing support for the hanger and bag assembly 31. When it is desired to remove and replace the hanger and bag assembly 31, the head is grasped with one hand and the body portion is grasped with the other hand and are twisted relative to one another. This action causes the bead segments 70 and bead 65 to cam out of engagement such that the head is removed.

In the form shown in FIGS. 15–18, the bead segments 65*a* are provided on the body portion 35*a* of the container and the continuous bead 70*a* is provided on the inner surface of the skirt of the head 36*a*.

The squeeze dispensing package thus provides seals as required for proper functioning as follows:

1. Between the head 36 and ferrule 50 and pouch 45 thereon.
2. Interference fit between hanger 40 and ferrule 50.
3. Interference fit between the hanger 40 and body portion 35.

The body 35 and the hanger 40 are made of a plastic material such that the side walls of the body 35 and the side walls of the hanger 40 are easily squeezable and yet are resilient enough and have sufficient elastic memory to return to normal when the squeeze is released.

The head 36, check valve 33 and cap 55 are preferably made of plastic such as polypropylene. The body 35 and the atmospheric or equalizer valve 34 are preferably made of plastic such as linear low density polyethylene. The hanger 40 and ferrule 50 are also preferably molded of plastic such as linear low density polyethylene.

As indicated, the cross section of body 35 is preferably oval to facilitate grasping and squeezing the body 35. The body 35 is sufficiently thin that it will flex under the squeezing pressure of a user. The flexible portion 44 of the hanger 40 has a configuration such that a space exists between the outer surface of the flexible portion 44 and the inner surface of the wall of the body portion 35 of the container. Thus, the flexible portion 44 of the hanger 40 will flex independently of the body 35.

The pouch 45 is made of a single layer or multilayer plastic film which will provide the desired protection for the product to be dispensed.

The design permits easy filling and assembly of the components. For example, the hanger and pouch assembly may be inserted into the body and filled with product through the ferrule 50. Air displaced during the filling process would be vented through the gate spider 67*a*. The head assembly 36 is then snapped onto the top of the body 35, with the internal plug seal 59 entering the ferrule 50, sealing the contents of the hanger and pouch assembly 31. The atmospheric valve 34 is bonded in place in the bottom wall 37. Alternatively, the hanger and pouch assembly 31 may be filled before insertion into the body 35. Labeling and protective wrapping operations would follow.

To dispense viscous product, the closure 55 must be removed. Then the front and back panels of the body 35 may be pressed inwardly. This action causes the film flap valve 68 of the atmospheric valve 34 to seat firmly against the ports 69. Continuous pressure against the panels will force the product through the valve 33 and outwardly through the nozzle 32. When external pressure has been released, the product will start to return to the inside of the pouch 45. This causes the valve 33 to close on the valve seat, stopping the return flow. Reduced internal pressure then causes the atmospheric valve 34 to lift away from the ports, admitting air into the space between the body 35 and the pouch 45. This causes the bottom of the pouch 45 to rise. Repeated dispensing of product continues to cause the bottom of the pouch 45 to rise until the product has been exhausted. At this point, the pouch 45 will have been inverted entirely within the hanger 40.

Thus, when the container 35 is squeezed, the hanger and pouch are also squeezed and the contents are dispensed. When the squeeze forces are removed, the container walls return to their original configuration. The reduced pressure between the pouch 45 and container walls 35 provides a force tending to return the pouch to its original configuration, assisted in part by the elastic memory of the hanger 41. At the same time, the reduced pressure in the contents of the pouch 45 closes the valve 33 in the nozzle 32 but this is not instantaneous.

The outer wall 35 of the package does not instantaneously return the pouch 55 to its substantially undeformed cross-section upon removal of opposed squeezing forces. The reduced pressure between the outer wall and the flexible pouch 55 provides a force tending to return the pouch to its original configuration, assisted in part by the elastic memory of the hanger. At the same time, the reduced pressure in the contents of the pouch 55 closes the valve 33 in the nozzle but this is not instantaneous.

The dispenser may be refilled by:

1. Removing the head assembly 36 from the body 35.
2. Lifting the empty hanger and pouch assembly 31 from the body 35.
3. Lowering a filled hanger and pouch assembly 31 into the body 35.
4. Removing any seal from top of the hanger and pouch assembly 31.
5. Firmly snapping the head 36 onto the top of the body 35.

Figure 19:
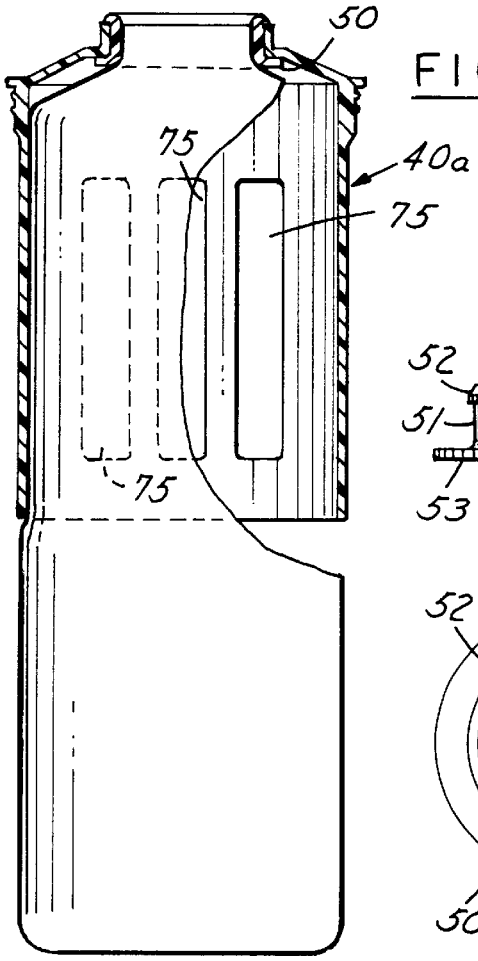
FIG. 19 is a part sectional elevational view of a modified hanger and pouch assembly.

In the form of hanger and pouch assembly shown in FIG. 19, the hanger 40*a* is modified to include a plurality of circumferentially spaced elongated openings 75 in order to provide greater flexibility in the side wall. In all other respects, the package is the same as that of FIGS. 1–10.

In the form of squeeze package shown in FIGS. 20–22A, the container 80 is formed without a bottom wall which is bonded to the container 80 so that the hanger and pouch assembly 82 can be inserted from the bottom of the container 80. After the insertion of the hanger and pouch assembly 82, a separate bottom wall 81 is bonded to the container 80. The head 83 is formed as an integral part of the container 80. In this form, the upper end of the pouch 84 is bonded directly to the opening in the hanger 85 without the use of a ferrule. The hanger 85 includes an integral cylindrical portion 86 into which the pouch extends and is bonded by heat sealing. An integral axial extension 87 on the hanger 85 is provided into which the nozzle 88 extends.

Axially spaced shoulders 89, 90 on the nozzle snap over a portion 91 of reduced diameter on the axial projection 87.

The container 80 has its upper end formed with a cylindrical axial wall 92. The hanger 85 includes a flange 93 and a radial wall 94 into which wall 93 of the container extends to support the hanger and pouch assembly 82.

Figure 22:
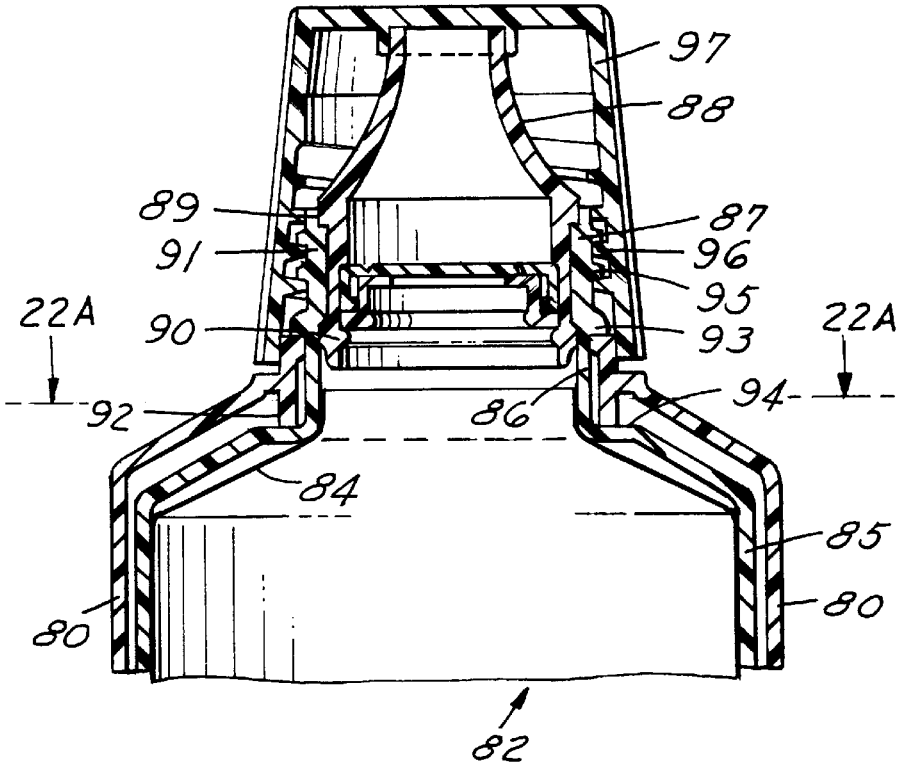
FIG. 22 is a sectional view on an enlarged scale of a portion of the package shown in FIG. 20.
Figure 22A:
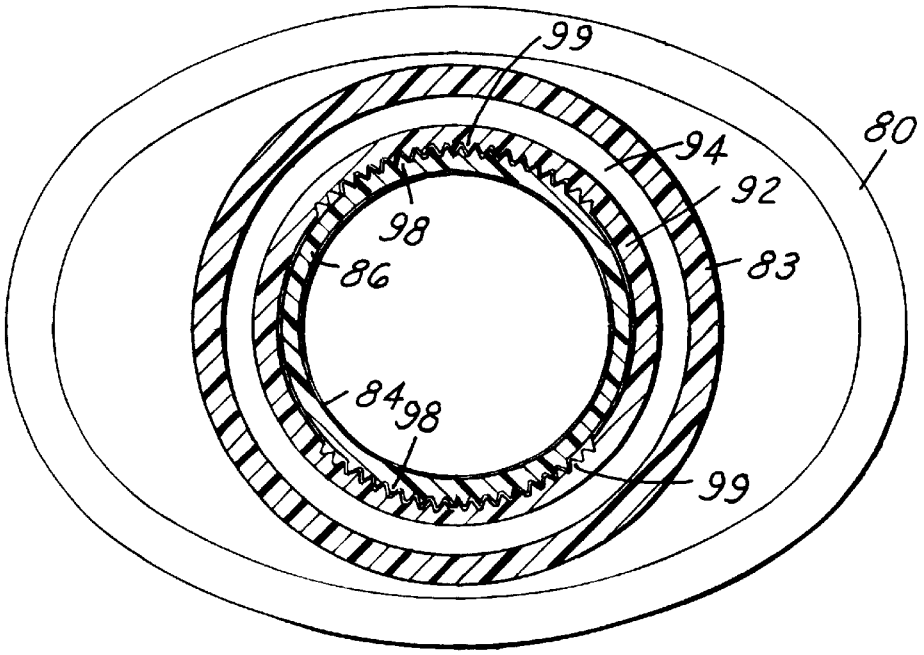
FIG. 22A is a sectional view taken along the line 22A—22A in FIG. 22.

The axial extension 87 is formed with external threads 95 for receiving the internal threads 96 on a closure 97. In order to prevent relative rotation and insure proper orientation between the hanger 85 and the container 80 axially extending teeth 98, 99 are provided between the wall 86 and wall 92 as shown in FIG. 22A.

In all other respects the squeeze dispensing package is constructed and functions like that shown in FIGS. 1–10.

Figure 20:
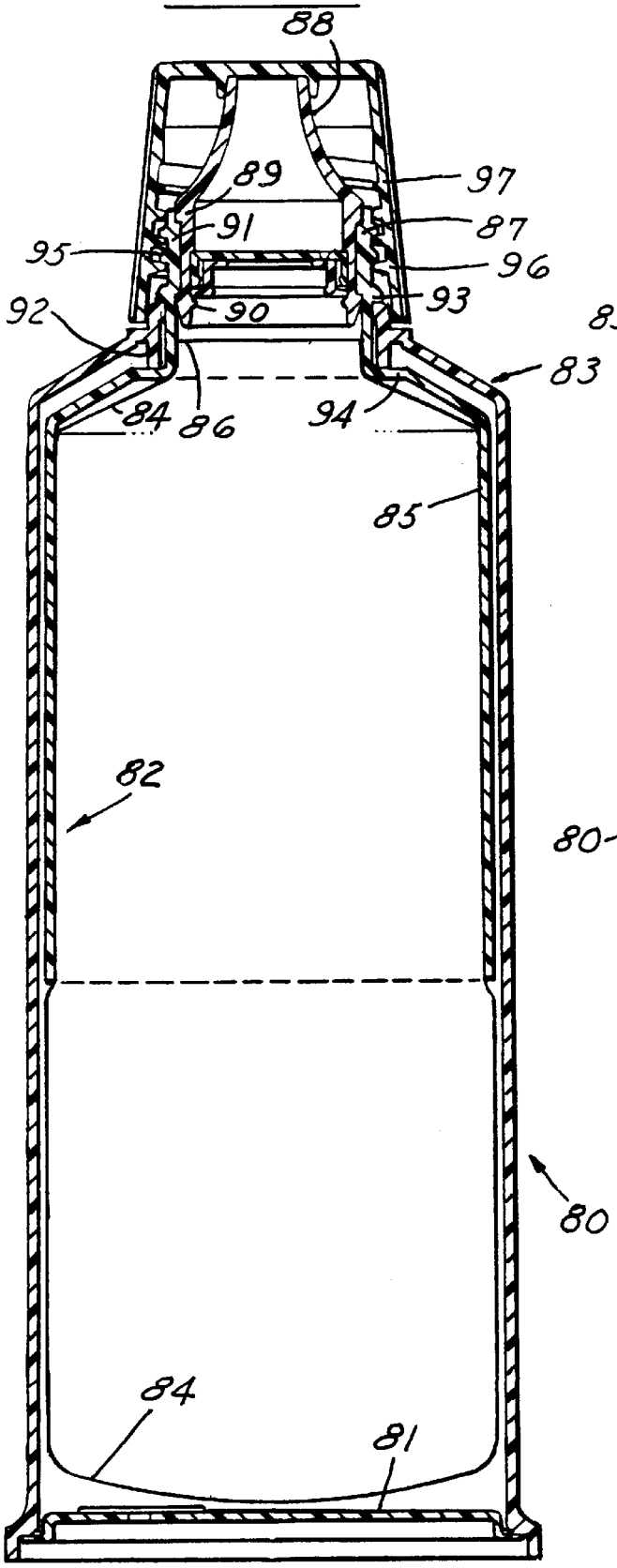
FIG. 20 is a sectional elevational view of a modified form of package.
Figure 21:
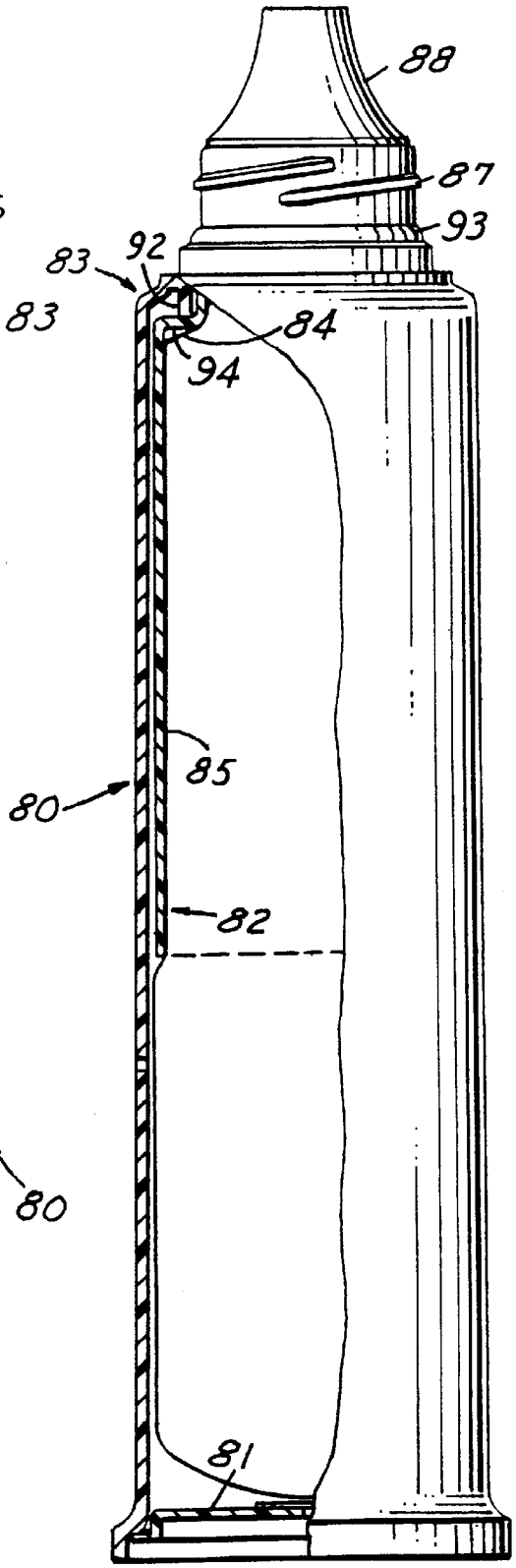
FIG. 21 is a part sectional side elevational view of the package shown in FIG. 9.
Figure 23:
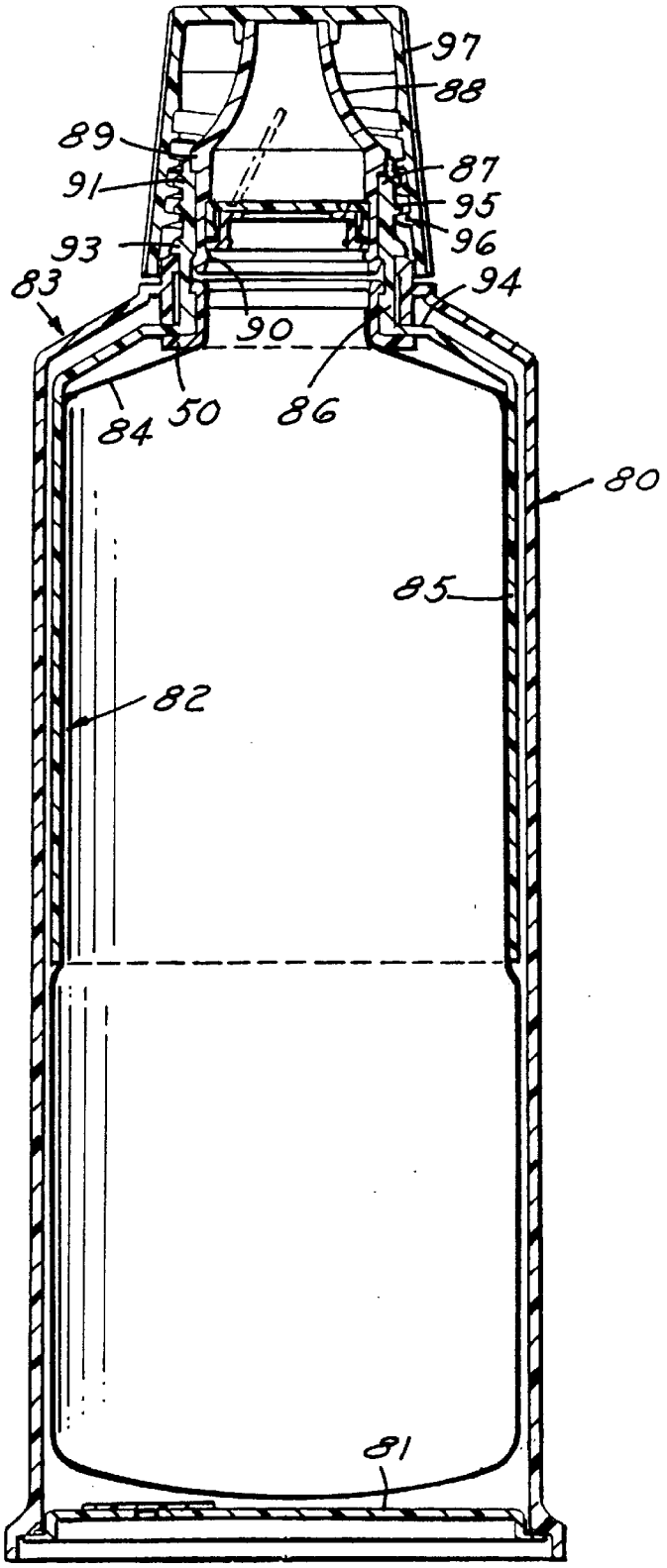
FIG. 23 is a sectional elevational view of another modified form of package.

In the form of squeeze package shown in FIG. 23, the construction is similar to that shown in FIGS. 20 and 21 except that a ferrule 50 is provided to which the open end of the pouch 84 is heat bonded.

Figure 24:
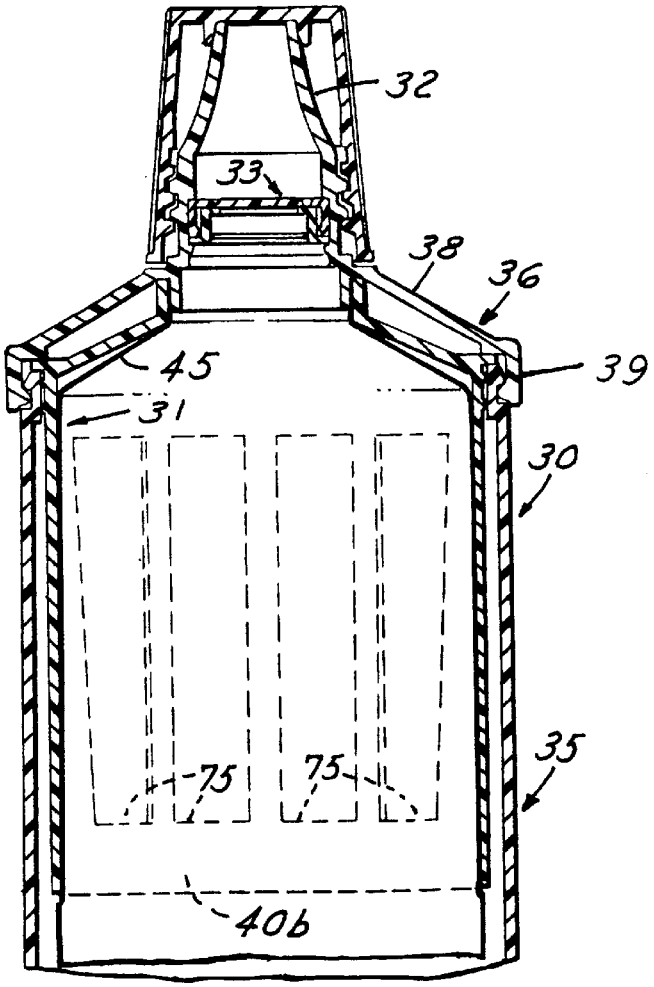
FIG. 24 is a fragmentary sectional elevational view of a further modified form of package.
Figure 25:
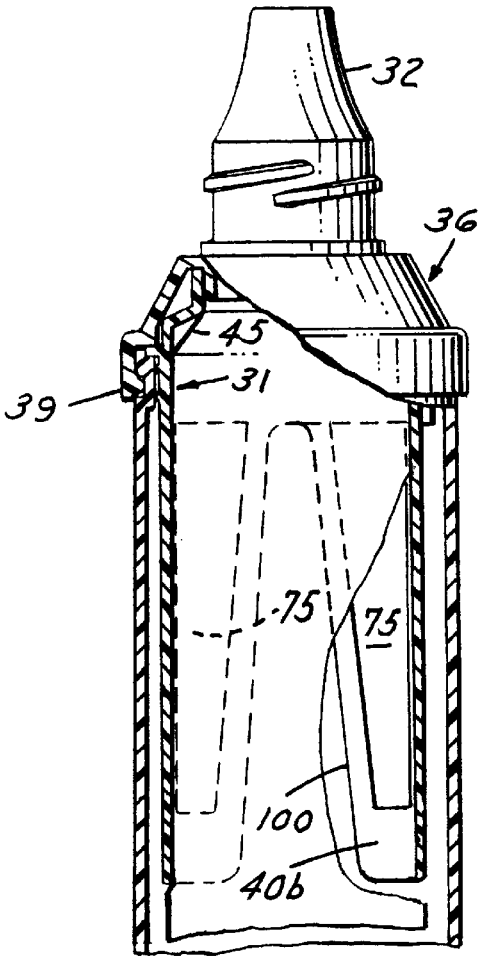
FIG. 25 is a fragmentary part sectional side elevational view of the package shown in FIG. 24.

In the form of dispensing package shown in FIGS. 24 and 25, the package is generally identical to that shown in FIGS. 1–14, except that a vertical tapered slit 100 is provided along the narrow sides of the flexible portion of the hanger 40*b* to permit further flexing of the skirt of the hanger.

Figure 26:
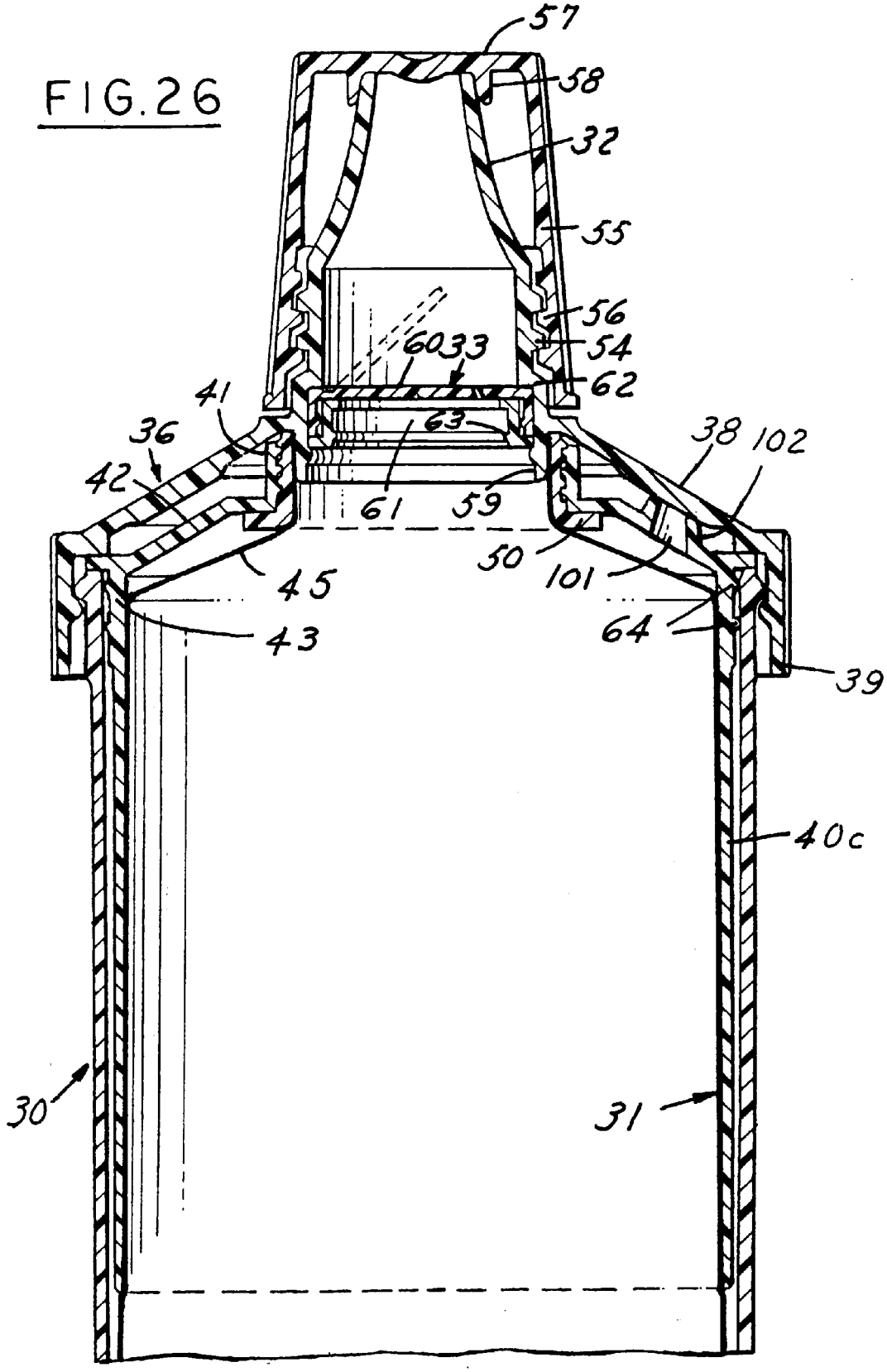
FIG. 26 is a fragmentary vertical sectional elevational view of another modified form of package.

In the form of the dispensing package shown in FIG. 26, the shoulder of a hanger 40*c* is formed with an opening 101 that permits venting of the between the pouch 45 and hanger 40 during the time that the pouch is being filled with product. This opening comprises an annular portion 102 that is engaged by the shoulder 38 on the hanger 40*c* to seal the opening 101 when the head is applied.

Figure 27:
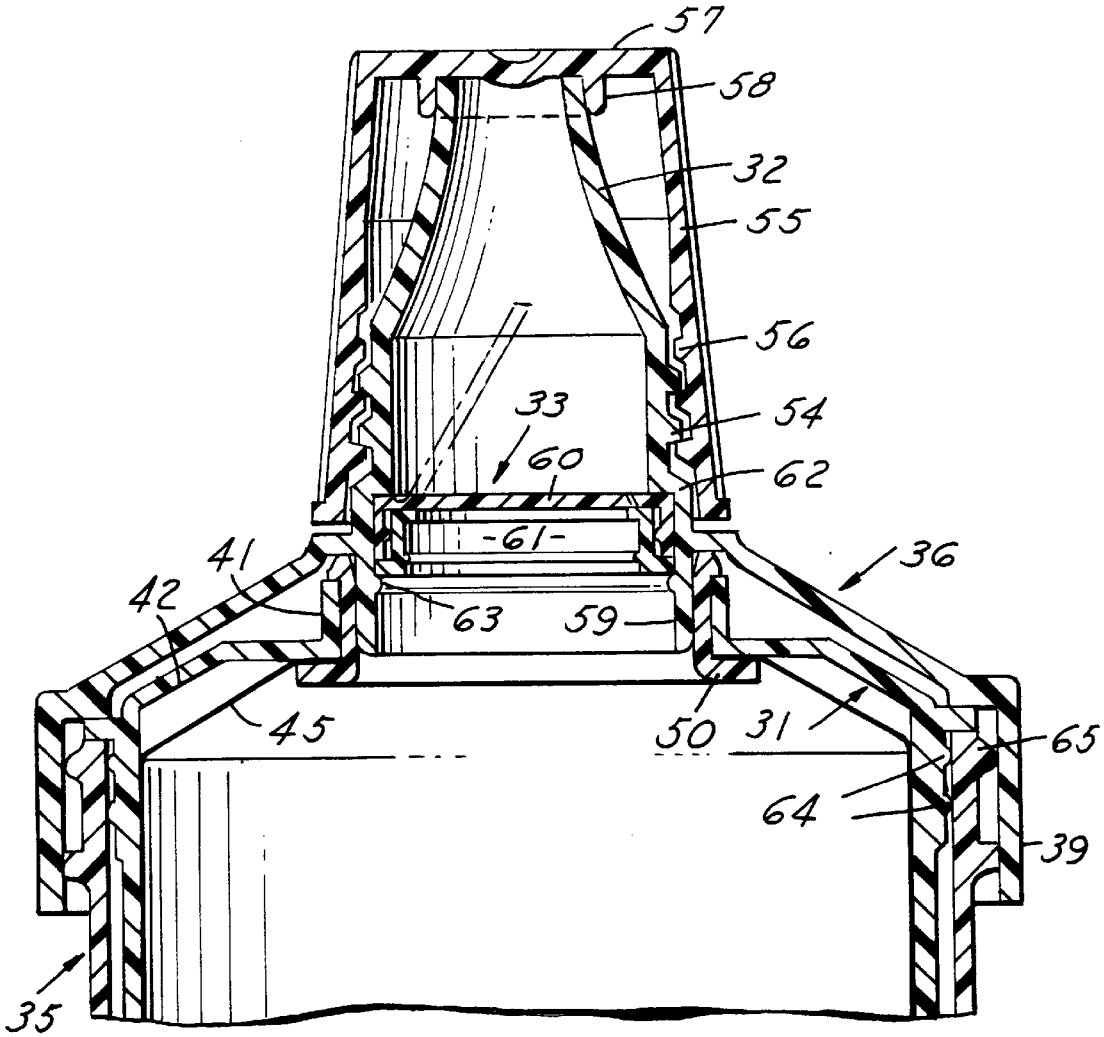
FIG. 27 is a fragmentary sectional view of a further modified form of package.

The form of squeeze dispensing package shown in FIG. 27 is like that shown in FIGS. 1–10 except that the pouch 45 is bonded by heat sealing to the exterior of the ferrule 50. In this form, the seal between the head 36 and hanger 40 is provided by the interference fit of axial extension 59 and the inside of the ferrule 50.

It can thus be seen that there has been provided a squeeze dispenser package which includes a novel hanger and pouch assembly; wherein the hanger and pouch assembly can be replaced; wherein the package can be readily manufactured in high production; and which efficiently dispenses the viscous product.

We claim:

1. A squeeze pump package comprising a plastic container having opposed compressible portions, a hanger and pouch assembly comprising a hanger and a pouch, said hanger being made of plastic material, means for suspending said hanger in said container, said hanger comprising a relatively rigid upper portion having an opening, said hanger having a lower portion comprising spaced flexible walls portions, said pouch comprising a plastic film pouch having an opening bonded adjacent the opening in the hanger and having portions thereof bonded of said flexible portions to said hanger, said film pouch comprising a sealed flexible lower portion extending beyond the lower portion of said hanger, means for providing a nozzle having an opening overlying the opening in the pouch, a check valve, means for mounting said check valve adjacent the opening in the hanger, and an atmospheric valve on said package for equalizing the pressure after the compressible portion of the container has been released and the hanger returns to its original position.

2. The squeeze dispenser package set forth in claim 1 wherein said pouch is bonded to an interior surface of the flexible portions of said hanger.

3. The squeeze dispenser package set forth in claim 2 wherein said portions of said pouch bonded to said hanger comprise axially and transversely spaced portions.

4. The squeeze dispenser package set forth in claim 2 wherein said portions of said pouch bonded to said hanger extend transversely.

5. The squeeze dispenser package set forth in claim 1 including a ferrule insertable into said opening in said hanger, said pouch being bonded to said ferrule.

6. The squeeze dispenser package set forth in claim 5 wherein said pouch is heat sealed to an exterior of said ferrule.

7. The squeeze dispenser package set forth in claim 5 wherein said pouch is heat sealed to an interior of said ferrule.

8. The squeeze dispenser package set forth in claim 1 wherein said means for suspending said hanger within said container comprises a removable head on said container, interengaging means between said hanger and said container and means for removably mounting said head on said container to hold said hanger and pouch assembly in position in said container.

9. The squeeze dispenser package set forth in claim 8 wherein said means providing a nozzle comprises a nozzle integral with said head.

10. The squeeze dispenser package set forth in claim 9 wherein said means for mounting said check valve comprises interengaging means between said hanger and said check valve.

11. The squeeze dispenser package set forth in claim 10 wherein said head includes a portion interengaging said hanger to form a seal with the opening of said pouch.

12. The squeeze dispenser package set forth in claim 11 wherein said pouch is bonded to an interior surface of the flexible portions of said hanger.

13. The squeeze dispenser package set forth in claim 12 wherein said portions of said pouch bonded to said hanger comprise axially and transversely spaced portions.

14. The squeeze dispenser package set forth in claim 13 wherein said portions of said pouch bonded to said hanger extend transversely.

15. The squeeze dispenser package set forth in claim 11 including a ferrule insertable into said opening in said hanger, said pouch being bonded to said ferrule.

16. The squeeze dispenser package set forth in claim 15 wherein said pouch is heat sealed to an exterior of said ferrule.

17. The squeeze dispenser package set forth in claim 15 wherein said pouch is heat sealed to an interior of said ferrule.

18. The squeeze dispenser package set forth in claim 8 wherein a body portion of said container has an upper end, said hanger including a flange engaging the upper end of said body portion of said container.

19. The squeeze dispenser package set forth in claim 18 wherein said interengaging means between said hanger and said container comprises said relatively rigid upper portion of said hanger having a portion extending into the upper end of said container and having an interference fit with said container.

20. The squeeze dispenser package set forth in claim 8 wherein said head and container are substantially oval, said means removably mounting said head and said container comprises an annular bead on one of said head and said container and an interengaging segment on long side of the other of said head and said container.

21. The squeeze dispenser package set forth in claim 20 wherein said annular bead is on said container and said segments is on said head.

22. The squeeze dispenser package set forth in claim 20 wherein said annular bead is on said head and said segments is on said container.

23. The squeeze dispenser package set forth in claim 8 wherein said hanger has a shoulder with a venting opening therein; said head having a portion closing said opening.

24. The squeeze dispenser package set forth in claim 1 wherein said means suspending said hanger and pouch assembly in said container comprises an annular portion on said hanger, an annular portion on an upper end of said container and interengaging means between said annular portions.

25. The squeeze dispenser package set forth in claim 24 wherein said means for providing a nozzle comprises a nozzle and interengaging means between said nozzle and said hanger for supporting said nozzle on said hanger.

26. The squeeze dispenser package set forth in claim 24 wherein said pouch is bonded to an interior surface of the flexible portions of said hanger.

27. The squeeze dispenser package set forth in claim 26 wherein said portions of said pouch bonded to said hanger comprise axially and transversely spaced portions.

28. The squeeze dispenser package set forth in claim 26 wherein said portions of said pouch bonded to said hanger extend transversely.

29. The squeeze dispenser package set forth in claim 24 including a ferrule insertable into said opening in said hanger, said pouch being bonded to said ferrule.

30. The squeeze dispenser package set forth in claim 29 wherein said pouch is heat sealed to an exterior of said ferrule.

31. The squeeze dispenser package set forth in claim 29 wherein said pouch is heat sealed to an interior of said ferrule.

32. A hanger and pouch assembly for use in a squeeze pump package comprising a plastic container having opposed compressible portions, comprising a hanger and a pouch, said hanger being made of plastic material, said hanger including means for suspending said hanger in a container, said hanger comprising a relatively rigid upper portion having an opening, said hanger having a lower portion comprising spaced flexible walls, said pouch comprising a plastic film pouch having an opening bonded adjacent the opening to the opening in the hanger and having portions thereof bonded to said flexible portions of said hanger, said film pouch comprising a sealed flexible lower portion extending beyond the lower portion of said hanger.

33. The hanger and pouch assembly set forth in claim 32 wherein said pouch is bonded to an interior surface of the flexible portions of said hanger.

34. The hanger and pouch assembly set forth in claim 33 wherein said portions of said pouch bonded to said hanger comprise axially and transversely spaced portions.

35. The hanger and pouch assembly set forth in claim 33 wherein said portions of said pouch bonded to said hanger extend transversely.

36. The hanger and pouch assembly set forth in claim 32 including a ferrule insertable into said opening in said hanger, said pouch being bonded to said ferrule.

37. The hanger and pouch assembly set forth in claim 36 wherein said pouch is heat sealed to an exterior of said ferrule.

38. The hanger and pouch assembly set forth in claim 36 wherein said pouch is heat sealed to an interior of said ferrule.

39. The hanger and pouch assembly set forth in claim 32 wherein said means for suspending said hanger and pouch assembly within a container comprises a removable head adapted to be mounted on a container to hold said hanger and pouch assembly in position in a container.

40. The hanger and pouch assembly set forth in claim 32 wherein said hanger includes a flange engaging the upper end of a body portion of a container.

41. The hanger and pouch assembly set forth in claim 40 wherein said relatively rigid upper portion includes a portion adapted to extend into an upper end of a container and have an interference fit with a container.

42. The hanger and pouch assembly set forth in claim 32 wherein said hanger has a shoulder with a venting opening therein.

43. An inner receptacle for containing a viscous product and for use with a squeeze container which is resiliently deformable substantially along its entire longitudinal length and has an outlet opening, said inner receptacle comprising:

an upper portion and a lower portion for being arranged in succession along the longitudinal length of the squeeze container;

said upper portion including an upper end having means for suspending the inner receptacle within the squeeze container and a discharge opening for being substantially aligned with said outlet opening;

said lower portion including a flexible liner for containing said viscous product;

said flexible liner heaving an open upper part, a sealed lower end, and an original filled shape;

said upper portion further including a resiliently deformable support means disposed proximate said outlet opening for radially supporting the upper part of said flexible liner, for maintaining the upper part of said flexible liner in substantially its original filled shape between dispensing operations, and for forcing said flexible liner to controlledly invert inside the upper portion during a dispensing operation thus displacing the viscous product within the flexible liner toward the discharge opening and permitting substantially all of the viscous product to be dispensed;

said support means having an original unstressed shape and being resiliently deformed during a dispensing operation when a squeeze force is applied to said squeeze container; and said support means having memory to allow it to return to its original unstressed shape after the squeeze force is removed from the container.

* * * * *

UNITED STATES PATENT AND TRADEMARK OFFICE

CERTIFICATE OF CORRECTION

PATENT NO. : 6,305,577 B1
DATED : October 23, 2001
INVENTOR(S) : William E. Fillmore It is certified that error appears in the above-identified patent and that said Letters Patent is hereby corrected as shown below:

Column 2,
Line 27, "FIG. 9" should read -- FIG. 20 --.

Column 3,
Line 29, "pouch 55" should read -- pouch 45 --.

Column 5,
Line 1, "container 35" should read -- container body 35 --.
Lines 12, 15 and 17, "pouch 55" should read -- pouch 45 --.

Signed and Sealed this

Seventh Day of May, 2002

*Attest:*

*Attesting Officer*

JAMES E. ROGAN
*Director of the United States Patent and Trademark Office*